US011323819B2

(12) United States Patent
Babb et al.

(10) Patent No.: US 11,323,819 B2
(45) Date of Patent: May 3, 2022

(54) HIGH POWER VOICE COIL

(71) Applicant: Robert Bosch GmbH, Stuttgart (DE)

(72) Inventors: Alan J. Babb, Burnsville, MI (US); Andrew M. Grunloh, Colombia Heights, MN (US)

(73) Assignee: Roberrt Bosch GmbH, Stuttgart (DE)

( * ) Notice: Subject to any disclaimer, the term of this patent is extended or adjusted under 35 U.S.C. 154(b) by 0 days.

(21) Appl. No.: 16/977,268

(22) PCT Filed: Feb. 22, 2019

(86) PCT No.: PCT/EP2019/054471
§ 371 (c)(1),
(2) Date: Sep. 1, 2020

(87) PCT Pub. No.: WO2019/166344
PCT Pub. Date: Sep. 6, 2019

(65) Prior Publication Data

US 2021/0006906 A1 Jan. 7, 2021

Related U.S. Application Data

(60) Provisional application No. 62/636,942, filed on Mar. 1, 2018.

(51) Int. Cl.

| | |
|---|---|
| ***H04R 9/04*** | (2006.01) |
| ***H04R 9/06*** | (2006.01) |
| ***H04R 9/02*** | (2006.01) |

(52) U.S. Cl.
CPC ..... *H04R 9/046* (2013.01); *H04R 9/022* (2013.01); *H04R 9/04* (2013.01); *H04R 9/045* (2013.01);

(Continued)

(58) Field of Classification Search
CPC ..... H04R 9/022; H04R 9/04; H04R 9/046; H04R 9/06; H04R 9/045; H04R 9/063; H04R 31/006; H04R 2209/041
See application file for complete search history.

(56) References Cited

U.S. PATENT DOCUMENTS 6,421,449 B1 * 7/2002 Hasegawa ..... H04R 9/046 381/401
6,993,147 B2 1/2006 Guenther
(Continued)

FOREIGN PATENT DOCUMENTS

CN 101674514 A 3/2010
CN 101998210 A 3/2011
(Continued)

OTHER PUBLICATIONS

International Search Report and Written Opinion for Application No. PCT/EP2019/054471 dated Jun. 9, 2019 (11 pages).
(Continued)

*Primary Examiner* — Huyen D Le
(74) *Attorney, Agent, or Firm* — Michael Best & Friedrich LLP

(57) ABSTRACT

A voice coil for use with a loudspeaker. The voice coil includes a bobbin that has a first layer of a non-conductive material infused with a high-temperature adhesive, a second layer of a non-conductive material infused with a high-temperature adhesive, and a layer of thermally-conductive material located in between the first layer of a non-conductive material and the second layer of a non-conductive substance, and a conductive wire wrapped around the bobbin.

18 Claims, 2 Drawing Sheets

(52) U.S. Cl.
CPC ..... *H04R 9/06* (2013.01); *H04R 9/063* (2013.01); *H04R 2209/041* (2013.01)

(56) References Cited

U.S. PATENT DOCUMENTS

| | | | | |
|---|---|---|---|---|
| 7,177,436 | B2 | 2/2007 | Tardo et al. | |
| 8,542,865 | B2 | 9/2013 | O'neill | |
| 2003/0118207 | A1* | 6/2003 | Kudo | H04R 9/06 381/397 |
| 2003/0123694 | A1 | 7/2003 | Kemmerer et al. | |
| 2005/0089187 | A1 | 4/2005 | Turnmire et al. | |
| 2006/0098839 | A1* | 5/2006 | Ishigaki | H04R 9/046 381/400 |
| 2006/0262956 | A1* | 11/2006 | Ishigaki | H04R 9/04 381/410 |
| 2008/0137902 | A1 | 6/2008 | Bohlender et al. | |

FOREIGN PATENT DOCUMENTS

| | | | |
|---|---|---|---|
| CN | 206402432 | U | 8/2017 |
| JP | S6116700 | A | 1/1986 |
| JP | S6196900 | A | 5/1986 |
| JP | S61121694 | A | 6/1986 |
| JP | H04170900 | A | 6/1992 |
| JP | H06325923 | A | 11/1994 |
| KR | 20100134886 | A | 12/2010 |

OTHER PUBLICATIONS

State Intellectual Property Office of People's Republic China Search Report for Application No. 201980016343.8 dated Nov. 27, 2020 (English translation, 2 pages).

* cited by examiner

-PRIOR ART-

HIGH POWER VOICE COIL

CROSS REFERENCE TO RELATED APPLICATIONS

This application claims priority to U.S. Provisional Patent Application No. 62/636,942, filed Mar. 1, 2018, the entire contents of which is incorporated by reference.

FIELD

Embodiments relate to a high power voice coil for use in a loudspeaker.

BACKGROUND

In loudspeakers, the vast majority of electrical energy that is fed into the transducer is transformed into heat rather than acoustic energy. In a low frequency transducer, the percentage of the energy fed into the transducer that is transformed into heat may be more than 90%, which means less than 10% of the energy is transformed into acoustic energy. This energy conversion to heat is done in wires that are wrapped around a bobbin in a structure called a voice coil.

Due to physical properties of the materials that are used to manufacture the voice coil, it is not practical to allow the voice coil to exceed approximately 550 degrees Fahrenheit (288 degrees Celsius). However, there is demand for more acoustic output without increasing the number of transducers used. Due to the physics involved, the transducer cannot simply be made more efficient in order to get a higher acoustic output. The efficiency of the transducer is related to the lowest frequency the transducer is able to effectively produce. Higher efficiency of the transducer leads to less low frequency output, thus limiting the frequency range of the loudspeaker.

SUMMARY

In order to dissipate thermal energy more efficiently without limiting the frequency range and acoustic output of the speaker, a high-power voice coil is needed.

One embodiment of the invention provides a voice coil. The voice coil includes a bobbin that has a first layer of a non-conductive material infused with a high-temperature adhesive, a second layer of a non-conductive material infused with a high temperature adhesive, and a layer of thermally-conductive material located in between the first layer of a non-conductive material and the second layer of a non-conductive substance, and a conductive wire wrapped around the bobbin.

DETAILED DESCRIPTION

Before any embodiments are explained in detail, it is to be understood that this disclosure is not intended to be limited in its application to the details of construction and the arrangement of components set forth in the following description or illustrated in the following drawings. Embodiments are capable of other configurations and of being practiced or of being carried out in various ways.

Figure 1:
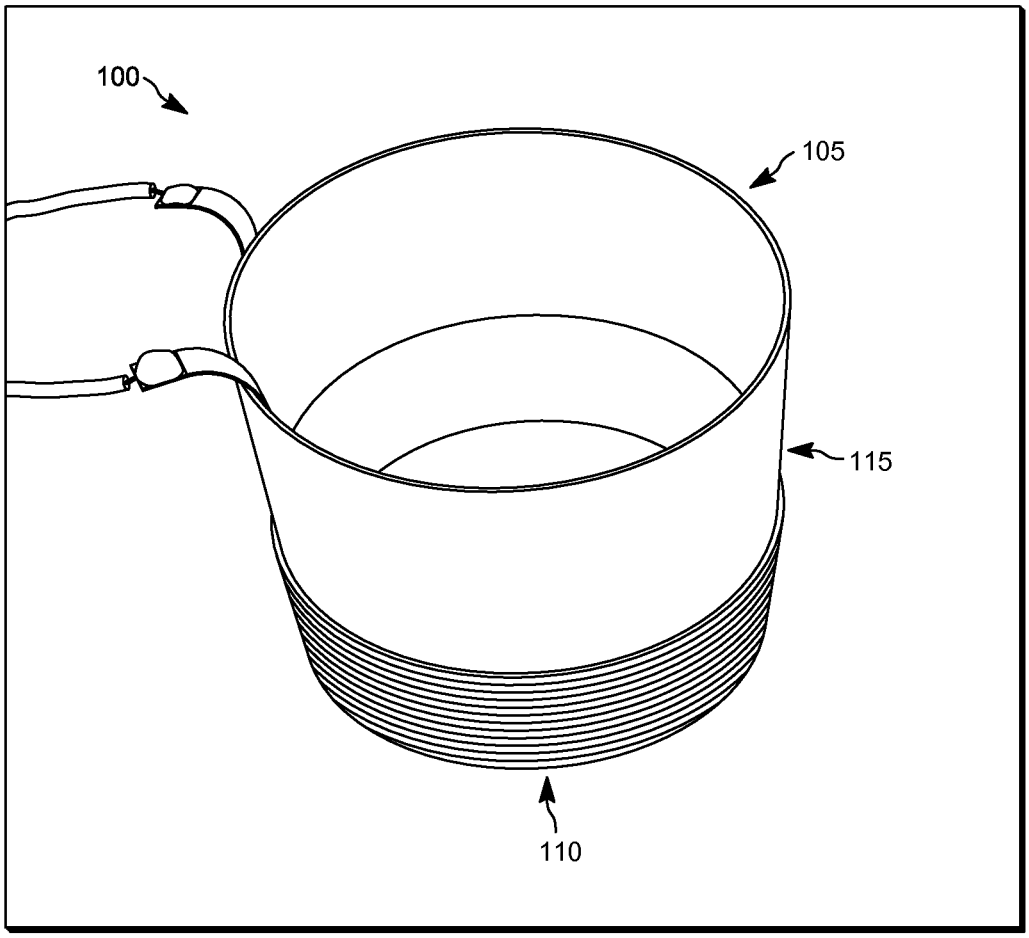
FIG. 1 illustrates a voice coil as known in the prior art.

FIG. 1 illustrates a voice coil 100. The voice coil 100 includes a former 105, a winding 110, and a collar 115. The former 105 is a bobbin made of a first material (for example, fiberglass). The former 105 may be covered with a film of material (such as polyimide) that is both an electrical insulator and resistant to high temperatures. However, the film may be difficult to bind the winding 110 to.

The winding 110 is, for example, an electromagnetic coil of conductive wire. The conductive wire is wound around the former 105. In some embodiments, the winding 110 is coated with a high temperature adhesive to help keep the winding 110 attached to the former 105 and absorb heat generated by current flowing through the winding 110. As described below, the high-temperature adhesive coating the winding 110 may be the same high-temperature adhesive that is infused into first and second non-conductive layers (e.g., polyimide) or a different high-temperature adhesive.

The collar 115 is placed over at least a portion of the former 105 and/or the winding 110 and facilitates the bonding of other loudspeaker components to the voice coil 100. The collar 115 is bound to the portion of the former 105 and is used to stiffen the former 105 and keep the former 105 from flexing due to mechanical forces generated by the winding 110.

By driving a current through the voice coil 100, a magnetic field is produced. The magnetic field causes the voice coil 100 to react to a permanent magnetic field fixed in a portion of a loudspeaker, which moves a cone of the loudspeaker.

There are at least two possible solutions to making the voice coil 100 more efficient. First, the ability to dissipate more thermal energy out of the voice coil 100 and into the world makes the voice coil 100 more efficient. Second, an increased thermal mass of the voice coil 100 makes the voice coil 100 more efficient, in part because an increased thermal mass increases the amount of thermal energy that can be stored. In order to accomplish both solutions, the former 105 may be made of a conductive material.

If the former 105 is made of the conductive material, a thermal mass of the voice coil 100 increases and an effective surface area for dissipating heat increases. However, if the conductive material is thermally conductive, the conductive material is also electrically conductive. This gives the former 105 the potential for shorting turns of wire of the winding 110. Another issue caused by the former 105 being electrically conductive is that the conductive former 105 cannot be a continuous loop, or it will act as an inductive brake when it is moved through the magnetic field created by a transducer motor structure in the loudspeaker. This causes the former 105 to become non-axisymmetric (for example, the voice coil 100 warps out of normal shape due to high temperatures) and, in addition to thermal expansion and contraction, contributes to dimensional instability (a degree to which the voice coil 100 fails to maintain its original dimensions when subject to changes in temperature) of the voice coil 100.

Dimensional instability is caused by high temperatures of the voice coil 100 that occur during use. For example, the voice coil 100 warps in shape and becomes non-round after multiple thermal cycles. With enough thermal cycling, the shape of the voice coil 100 warps enough to make physical contact with stationary parts of a transducer of the loudspeaker. This causes both unwanted noise and early failures of components.

Figure 2:
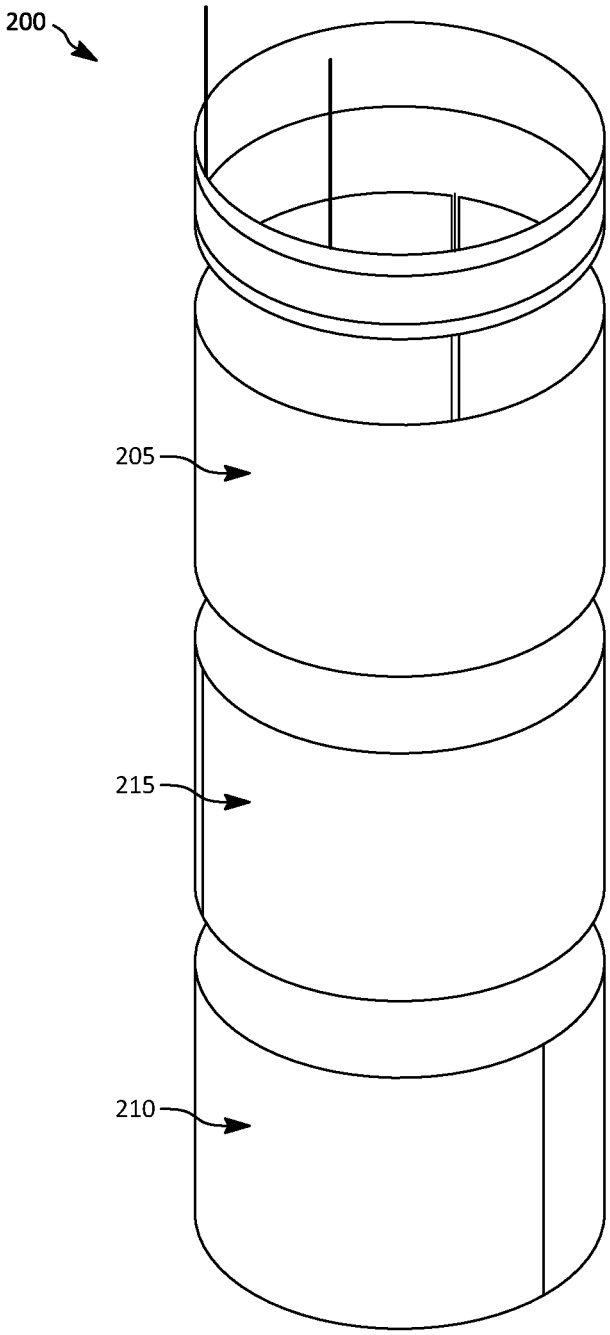
FIG. 2 illustrates a bobbin of a high power voice coil according to one embodiment.

FIG. 2 illustrates a bobbin 200 of a high power voice coil designed to solve the above-mentioned problems caused by a conductive former. In addition to the components described below, the bobbin 200 may have a winding wound around the bobbin 200 and a collar.

In the example shown, the bobbin 200 includes a first layer 205. The first layer 205 includes an electrically non-conductive material (for example, fiberglass, Nomex, etc.) infused with a high-temperature adhesive (for example, an adhesive that can withstand temperatures up to about 600 degrees Fahrenheit). One example of the high-temperature adhesive is a polyimide adhesive. Because the first layer 205 comprises these materials, the first layer 205 is dimensionally stable at high temperatures and electrically non-conductive. In one example, the first layer 205 is an outer layer of the bobbin 200.

The bobbin 200 also includes a second layer 210 that includes an electrically non-conductive material infused with a high-temperature adhesive. In one example, the second layer 210 is an inner layer of the bobbin 200.

In one embodiment, the first layer 205 and the second layer 210 are made of the same electrically non-conductive material (for example, fiberglass). In other embodiments, the first layer 205 and the second layer 210 are made of two different electrically non-conductive materials (for example, to take advantage of individual thermal or electrical properties of different materials).

In between the first layer 205 and the second layer 210 is a thermal layer 215. The thermal layer 215 comprises a thermally conductive material (for example, copper). The thermal layer 215 has the thermal dissipation benefits of a conductive former. By placing the thermal layer 215 between the first layer 205 and the second layer 210, the bobbin 200 can both dissipate thermal energy (through the thermal layer 215) while maintaining dimensional stability of the bobbin 200 and not bring a winding on the bobbin 200 (for example, a winding similar to the winding 110) into contact with other electrical components of a loudspeaker due to the first layer 205 and the second layer 210.

By both dissipating thermal energy through the thermal layer 215 and maintaining dimensional stability because of the first layer 205 and the second layer 210, the bobbin 200 can have more current provided to it and therefore can operate at higher power levels than voice coils without these components.

Thus, embodiments described herein describe a voice coil, comprising a bobbin composed of a first layer of a non-conductive material infused with a high-temperature adhesive, a second layer of a non-conductive material infused with a high-temperature adhesive, and a layer of thermally-conductive material located in between the first layer of a non-conductive material and the second layer of a non-conductive material, and a conductive wire wrapped around the bobbin.

Various features, advantages, and embodiments are set forth in the following claims.

What is claimed is:

1. A voice coil, comprising:

a bobbin including a first outer layer of a non-conductive material infused with a high-temperature adhesive, a second innermost layer of a non-conductive material infused with a high-temperature adhesive, and a middle layer of thermally-conductive material located in between the first outer layer of the non-conductive material and the second inner layer of the non-conductive material, and a conductive wire wrapped around the bobbin, wherein the bobbin only includes the first outer layer, the second inner layer and the middle layer.

2. The voice coil of claim 1, wherein the conductive wire is coated with a high temperature adhesive.

3. The voice coil of claim 2, wherein the conductive wire is coated with the same high-temperature adhesive that is infused in the first outer layer and the second inner layer.

4. The voice coil of claim 2, wherein the conductive wire is coated with a different high-temperature adhesive than the high-temperature adhesive infused in the first outer layer and the second inner layer.

5. The voice coil of claim 1, wherein a collar covers at least a portion of the bobbin.

6. The voice coil of claim 5, wherein the collar is configured to allow the voice coil to bond with another component of a loudspeaker.

7. The voice coil of claim 1, wherein a collar covers at least a portion of the conductive wire.

8. The voice coil of claim 7, wherein the collar is configured to allow the voice coil to bond with another component of a loudspeaker.

9. The voice coil of claim 1, wherein the first outer layer of the non-conductive material and the second inner layer of the non-conductive material comprise the same non-conductive material.

10. The voice coil of claim 1, wherein the first outer layer of the non-conductive material and the second inner layer of the non-conductive material comprise two different non-conductive materials.

11. The voice coil of claim 1, wherein the high-temperature adhesive is a polyimide adhesive, and wherein the second inner layer includes an inner surface that is not in contact with another layer and an outer surface that is in contact with the middle layer.

12. A voice coil, comprising:

a bobbin consisting of:

a first outer layer of a non-conductive material infused with a high-temperature adhesive, a second innermost layer of a non-conductive material infused with a high-temperature adhesive, and a middle layer of thermally-conductive material located in between the first outer layer of the non-conductive material and the second inner layer of the non-conductive material, and a conductive wire wrapped around the bobbin, wherein the bobbin only includes the first outer layer, the second inner layer and the middle layer.

13. The voice coil of claim 12, wherein the first outer layer and the second inner layer are fiberglass so that the first outer layer and the second inner layer are dimensionally stable at high temperatures and electrically non-conductive.

14. The voice coil of claim 13, wherein the middle layer is copper for dissipating thermal energy.

15. The voice coil of claim 12, wherein the middle layer is copper for dissipating thermal energy.

16. The voice coil of claim 12, wherein a collar covers at least a portion of the bobbin.

17. The voice coil of claim 16, wherein the collar is configured to allow the voice coil to bond with another component of a loudspeaker.

18. The voice coil of claim 12, wherein the second inner layer includes an inner surface that is not in contact with another layer and an outer surface that is in contact with the middle layer.

* * * * *